US012320245B2

(12) United States Patent
Kemoun

(10) Patent No.: US 12,320,245 B2
(45) Date of Patent: Jun. 3, 2025

(54) IN-SITU DOWNHOLE SEPARATION FOR OIL AND GAS RESERVOIRS

(71) Applicant: Chevron U.S.A. Inc., San Ramon, CA (US)

(72) Inventor: Abdenour Kemoun, Orinda, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/728,191

(22) PCT Filed: Feb. 10, 2023

(86) PCT No.: PCT/US2023/062343
§ 371 (c)(1),
(2) Date: Jul. 11, 2024

(87) PCT Pub. No.: WO2023/154836
PCT Pub. Date: Aug. 17, 2023

(65) Prior Publication Data

US 2024/0418069 A1 Dec. 19, 2024

Related U.S. Application Data

(60) Provisional application No. 63/308,934, filed on Feb. 10, 2022.

(51) Int. Cl.
*E21B 43/38* (2006.01)
*E21B 43/40* (2006.01)

(52) U.S. Cl.
CPC ..... *E21B 43/385* (2013.01); *E21B 43/38* (2013.01)

(58) Field of Classification Search
CPC ..... E21B 43/385; E21B 43/38
See application file for complete search history.

(56) References Cited

U.S. PATENT DOCUMENTS 1,655,817 A * 1/1928 Marsh ..... E21B 43/38 166/105.5
1,697,321 A * 1/1929 Marsh ..... E21B 43/38 166/105.1

(Continued)

OTHER PUBLICATIONS

SLB Energy Glossary entry for "gasdrive", accessed Oct. 10, 2024.*

(Continued)

*Primary Examiner* — Blake Michener
(74) *Attorney, Agent, or Firm* — Avery L. Cate

(57) ABSTRACT

A method of separating gas and liquid within a well bore includes positioning a production tube within the well bore such that the production tube extends from a subterranean reservoir, traverses a gas cap, and out of the production well bore. An in-situ downhole separation system is configured such that during production, produced fluid enters a separation zone formed in the well bore. The fluid flows within the separation zone in a direction from the reservoir and toward the gas cap, and at least some gas of the produced fluid separates from liquid of the produced fluid as separated gas that is reinjected into the gas cap. The remaining fluid is withdrawn through the production tube. Additional amounts of the gas may be separated from the liquid using a gas liquid separation device and/or a pump mechanism of the in-situ downhole separation system.

24 Claims, 2 Drawing Sheets

(56) References Cited

U.S. PATENT DOCUMENTS 1,732,499 A * 10/1929 Chancellor ..... E21B 43/38 137/197
2,029,323 A * 2/1936 Jones ..... E21B 43/35 166/105.1
2,429,043 A * 10/1947 Barnhart ..... E21B 43/38 166/105.1
2,748,719 A * 6/1956 Wells ..... E21B 43/38 166/105.5
3,386,390 A * 6/1968 Fair ..... E21B 43/38 166/105.5
3,408,949 A 11/1968 Hart, Jr.
5,443,120 A * 8/1995 Howell ..... E21B 41/0057 166/313
5,605,193 A * 2/1997 Bearden ..... E21B 43/128 417/66
5,653,286 A * 8/1997 McCoy ..... E21B 43/38 166/105.5
6,039,121 A * 3/2000 Kisman ..... E21B 43/38 166/372
6,089,322 A * 7/2000 Kelley ..... E21B 43/38 166/372
6,092,599 A 7/2000 Berry
6,719,048 B1 * 4/2004 Ramos ..... E21B 43/38 166/250.15
7,377,314 B2 * 5/2008 Gonzalez ..... E21B 43/38 166/105.5
9,022,106 B1 * 5/2015 McCoy ..... E21B 43/38 166/105.5
11,459,859 B2 * 10/2022 Branting ..... E21B 43/121
11,525,348 B2 * 12/2022 Xiao ..... E21B 43/38
12,006,810 B2 * 6/2024 Saponja ..... E21B 43/121
2002/0023750 A1 * 2/2002 Lopes ..... E21B 43/38 166/265
2002/0053426 A1 * 5/2002 Kelley ..... E21B 43/121 166/67
2003/0047310 A1 3/2003 Thomas
2007/0119098 A1 5/2007 Diaz
2007/0119588 A1 * 5/2007 Gonzalez ..... E21B 43/38 166/268
2016/0186550 A1 6/2016 Ramsey
2016/0333681 A1 * 11/2016 Mazzanti ..... E21B 43/38
2017/0191355 A1 * 7/2017 Mazzanti ..... F04B 47/02
2017/0292361 A1 * 10/2017 Beauquin ..... F03B 13/02
2023/0193738 A1 * 6/2023 Saponja ..... E21B 43/38 166/265
2023/0323763 A1 * 10/2023 Saponja ..... E21B 43/122

OTHER PUBLICATIONS

PCT International Search Report and Written Opinion mailed on Jun. 8, 2023 issued in Application No. PCT/US2023/062343, filed on Feb. 10, 2023, 10 pages.

* cited by examiner

IN-SITU DOWNHOLE SEPARATION FOR OIL AND GAS RESERVOIRS

CROSS-REFERENCE TO RELATED APPLICATION

This application claims the benefit of U.S. Provisional Patent Application No. 63/308,934, filed Feb. 10, 2022, which is incorporated by reference herein in its entirety.

TECHNICAL FIELD

This disclosure relates generally to the treatment of produced fluids generated in oil and gas wells. More particularly, the present disclosure relates to the separation of gas from liquids (e.g., oil) of produced fluids.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

In underground oil and gas reservoirs, downhole pressures can reach levels at which significant amounts of gases are dissolved in the oil. As an example, certain reservoirs can have pressures of several hundred bar at depths kilometers underground. When a stream of produced materials (e.g., including liquids and gases) in the well reaches a certain depth (i.e., is drawn up from a higher pressure location), the pressure is reduced sufficiently such that dissolved gas will disengage from the liquids. In some cases, the gas volume fraction can be quite high (e.g., above 50%). Much of this gas may be of low value and requires treatment and/or well injection, which can limit overall oil production rates.

The production of fluids from oil and gas reservoirs containing high levels of hydrogen sulfide ($H_2S$), for instance, requires the treatment and separation of the $H_2S$ from both the produced oil and the produced natural gas and the excess sour gas is treated and safely disposed of by re-injection into the reservoir. There are widely practiced methods of processing produced fluids with high $H_2S$ once the fluids reach the land surface. Such methods may employ processing steps including, by way of non-limiting example, gas separation, dehydration, fractionation, scrubbing, compression, reinjection, and sulfur recovery. The equipment used to perform any one of these processes may represent a bottleneck that limits overall production.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with various aspects of this disclosure, systems and methods for separating gas and liquid within a production well bore may include positioning a production tube within the well bore such that the production tube extends from a subterranean reservoir, traverses a gas cap, and out of the production well bore. An in-situ downhole separation system is configured such that during production from the subterranean reservoir, produced fluid enters a separation zone formed within the well bore. The fluid flows within the separation zone in a direction from the reservoir and toward the gas cap, and at least some gas of the produced fluid separates from liquid of the produced fluid as separated gas that is reinjected into the gas cap. The remaining fluid, which has much less gas compared to the initially produced fluid, is withdrawn through the production tube. Additional amounts of the gas may be separated from the liquid using a gas liquid separation device and/or a pump mechanism of the in-situ downhole separation system.

In one embodiment, a method of separating gas and liquid within a production well bore formed in a subterranean formation includes positioning a production tube within the production well bore such that the production tube extends from a subterranean reservoir, traverses a gas cap, and out of the production well bore. The method also includes positioning a gas separation tube around the production tube such that a spill point is formed; producing fluids from the subterranean reservoir such that: the fluid enters a separation zone between the gas separation tube and a casing of the production well bore, the fluid flows within the separation zone in a direction from the subterranean reservoir and toward the gas cap to the spill point, and at least some gas of the produced fluid separates from liquid of the produced fluid as separated gas while the liquid spills over the spill point and into a liquid holdup between the gas separation tube and the production tube.

In another embodiment, an in-situ downhole separation system includes a production well bore formed in a subterranean formation through a gas cap and into a production reservoir. The production well bore has a casing assembly with a first set of perforations configured to allow produced fluid to enter the production well bore from the production reservoir and a second set of perforations configured to allow separated gas to be reinjected into the gas cap. A production tube of the system is disposed within the production well bore and a gas separation tube is positioned around the production tube and connected to the casing assembly of the production well bore. The system also includes a separation zone between the gas separation tube and a casing of the production well bore, a liquid holdup between the gas separation tube and the production tube, and a spill point between the separation zone and the liquid holdup. The in-situ downhole separation system is configured such that the produced fluid enters the separation zone, flows within the separation zone in a direction from the reservoir and toward the gas cap to the spill point, and at least some gas of the produced fluid separates from liquid of the produced fluid as separated gas while the liquid spills over the spill point and into the liquid holdup.

In a further embodiment, an in-situ downhole separation system includes a production well bore formed in a subterranean formation through a gas cap and into a production reservoir, the production well bore having a casing assembly with a first set of perforations configured to allow produced fluid to enter the production well bore from the production reservoir and a second set of perforations configured to allow separated gas to be reinjected into the gas cap. The system includes a production tube disposed within the production well bore and sealed against the casing assembly above the second set of perforations to form a pressurized gas zone, and a separation device positioned proximate an inlet of the production tube. The separation device is configured to intake the produced fluid and to separate gas of the produced fluid from oil of the produced fluid as separated gas and thereby generate a gas-rich produced fluid stream and a gas-depleted produced fluid stream. The separation device is also configured to direct the gas-rich produced fluid stream toward a separation zone located under the pressurized gas zone; and to direct the gas-depleted produced fluid stream toward an inlet of the production tube. The system further includes a pump mechanism configured to control ΔP within the production tube to control a pressure gradient from the production reservoir to the pressurized gas zone such that the pressurized gas zone has a pressure sufficient to reinject at least some of the separated gas into the gas cap.

BRIEF DESCRIPTION OF THE DRAWINGS

These and other objects, features and advantages of the present disclosure will become better understood with reference to the following description, appended claims and accompanying drawings, wherein:

DETAILED DESCRIPTION

As set forth above, the treatment and/or well injection of disengaged gas from oils can have the effect of limiting oil production rates. In accordance with an aspect of this disclosure, it is now recognized that it may be desirable to separate at least a part of the gas from liquid (e.g., oil) phase within the well bore and reduce the volume of gas brought to the land surface (which may be referred to herein as "surface gas"). Disclosed herein are systems and methods for in-situ separation of gas and liquid in a well bore, which are referred to herein as in-situ downhole separation systems and methods. The disclosed in-situ downhole separation approaches may be used in configurations where a well bore penetrates through a subterranean formation having a gas cap above a reservoir. When the gas is separated, the separated gas may be reinjected into the formation, particularly the gas cap zone, while the resultant gas-reduced oil is produced to the surface. As described in detail below, at least some of the gas may be separated away from the liquid by among other things, maintaining pressure in the well bore between a gas cap pressure and a reservoir bottom pressure to drive the gas out of the liquid and into the gas cap. Certain approaches may use devices to drive additional gas out of the oil, as described below.

Benefits of the disclosed approaches include, but are not limited to, a reduced production cost of oil per barrel and reduced surface gas generation and associated processing. Reducing gas brought to the land surface and the associated treatment and reinjection of this gas may allow for reduced reliance on surface facilities used to separate and/or dry the surface gas, and on large compression equipment for its reinjection into the reservoir. In reservoirs that produce significant amounts of sour gas, this can result in significantly reduced $H_2S$ processing and potential exposure at the surface.

The present approaches may be applicable to the recovery of subterranean resources from a variety of subterranean formations. Certain embodiments may be employed for relatively deep reservoir wells (e.g., wells having a reservoir that is greater than 0.5 km below the land surface), while other embodiments may be employed for a wider variety of wells including such deep reservoir wells and shallower wells.

Figure 1:
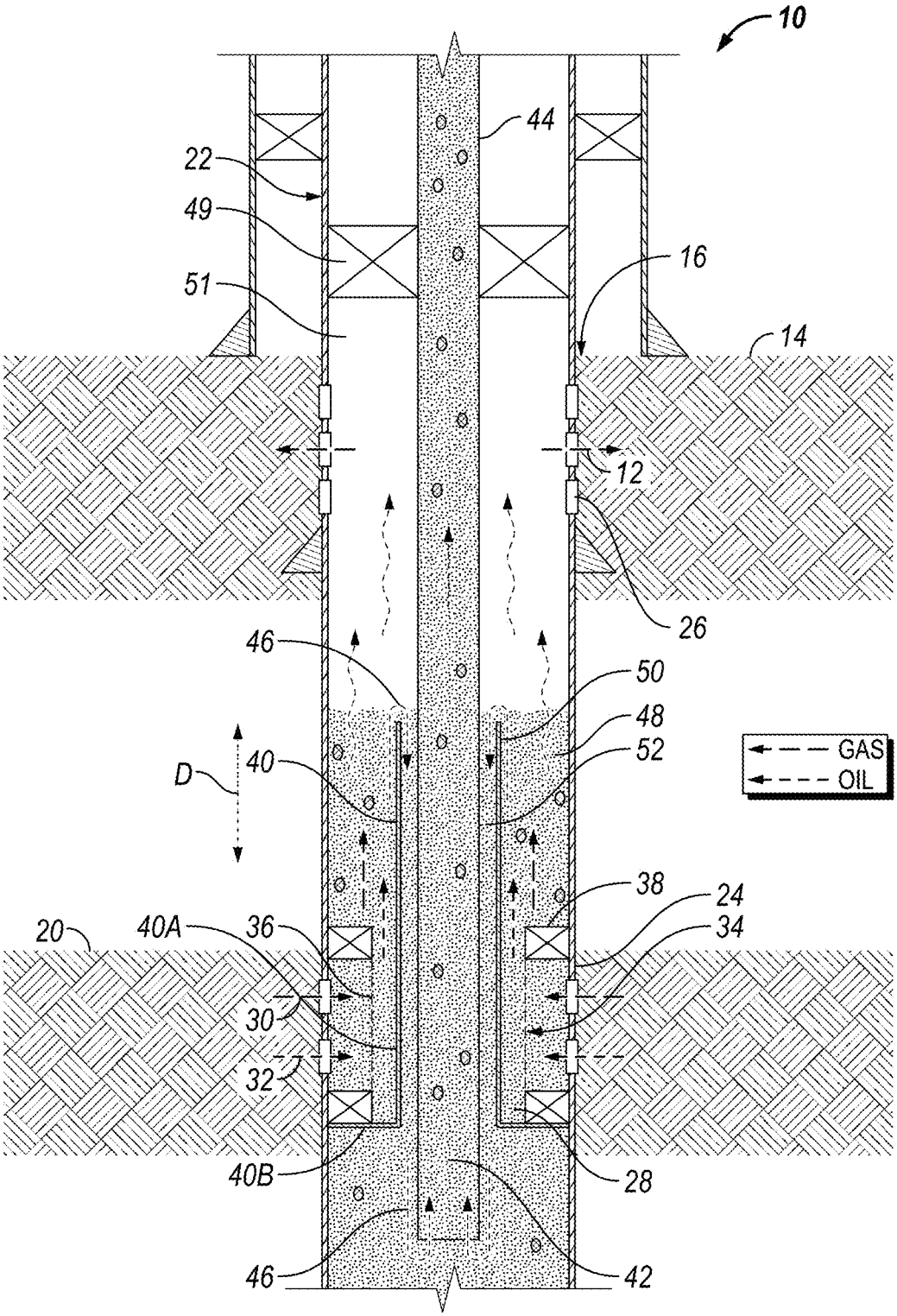
FIG. 1 is a schematic illustration of an in-situ downhole separation system used for separation of gas and oil within a well bore using gravity as a driving force for separation and reinjection of the separated gas into the formation, in accordance with an embodiment of this disclosure.

FIG. 1 is a schematic diagram depicting an embodiment of an in-situ downhole separation system 10 and its use of gravity as a driving force for reinjection of separated gas 12 into a gas cap 14. In the illustrated embodiment of FIG. 1, the in-situ downhole separation system 10 is used in conjunction with a well bore 16 penetrating a subterranean formation 18 through the gas cap 14 and into a production reservoir 20. A casing assembly 22 of the in-situ downhole separation system 10 supports the well bore 16 and includes a first set of perforations 24 corresponding to a downhole location of the production reservoir 20 and a second set of perforations 26 corresponding to a downhole location of the gas cap 14.

The first set of perforations 24 allow a produced fluid 28 including gas 30 and oil 32 to flow into an interior of the casing assembly 22. The second set of perforations 26 allow the separated gas 12 to flow from the interior of the casing assembly 22 and into the gas cap 14, which may also be referred to as a gas disposal zone. The first set of perforations 24 and the second set of perforations 26 may be separated by a distance D sufficient to allow gravity to assist with the reinjection process. By way of non-limiting example, the distance D may be between 0.5 km and 1 km.

The manner in which the gas 30 separates from the oil 32 and is reinjected may be further appreciated with reference to the manner in which the produced fluid 28 flows through the in-situ downhole separation system 10. As illustrated in FIG. 1, the produced fluid 28 enters the well bore 16 through the first set of perforations 24 and passes through a downhole screen assembly 34 that may be used for filtration of the produced fluid 28 proximate the first set of perforations 24, and which may include one or more screens 36 and seals 38. Specifically, the produced fluid 28 flows from the reservoir 20 at an initial, relatively high downhole pressure P1. The one or more screens 36, in some embodiments, may be configured by adding enhanced nucleation devices into the flow of the produced fluid 28, which may facilitate certain of the gas separation processes described herein.

A gas separation tube 40 is secured to the casing assembly 22 below the first set of perforations 24. This attachment blocks a direct path for the produced fluid 28 to move toward an inlet 42 of a production tube 44 positioned relatively concentrically within the gas separation tube 40. More specifically, in the embodiment illustrated, the gas separation tube 40 is attached to one of the seals 38 (e.g., a bottom most seal) of the downhole screen assembly 34. Other methods of securing the gas separation tube 40 to the casing assembly 22 may be used, such as a direct connection to the wall of the casing assembly 22 or an additional seal against the wall.

The gas separation tube 40 performs several functions due to its configuration. In particular, the gas separation tube 40 includes a first portion 40*a* that extends vertically (i.e., generally aligned with an axis of the well bore 16) and a second portion 40*b* that extends radially with respect to the axis of the well bore 16. The second portion 40*b* blocks the direct flow of produced fluid 28 into the production tube 44, while the first portion 40*a* directs the produced fluid 28 in an upward direction (toward the second set of perforations 26). The gas separation tube 40 may have a variety of other configurations and is not necessarily limited to having both the first portion 40*a* and the second portion 40*b*. For example, the gas separation tube 40 may be a singular tube that has no diverging portions. In such a configuration, seals, protrusions, or the like, may be integrated into the system 10 to connect the gas separation tube 40 to the casing assembly 22 and block the flow of the produced fluid 28 in the manner described. In other embodiments the production tube 44 may not extend beyond the gas separation tube 40 and the gas separation tube 40 may extend to the bottom of the well bore 16. Additionally, while the first portion 40*a* is shown as being generally parallel with respect to the casing assembly 22, the gas separation tube 40 may additionally or alternatively have sections that converge toward the casing assembly 22 or diverge away from the casing assembly 22.

As illustrated in FIG. 1, as the produced fluid 28 moves in the upward direction along the first portion 40*a* (i.e., within the annular space between the casing assembly 22 and the gas separation tube 40), it experiences a pressure decrease resulting in disengagement of dissolved and entrained gas 30 from the oil 32. That is, at least a portion of the gas 30 that was dissolved within the oil 32 comes out of solution as the separated gas 12, thereby generating a gas-reduced produced fluid 46. In the illustrated embodiment, the annular space between the gas separation tube 40 and the casing assembly 22 may be referred to as a separation zone 48. In accordance with present embodiments, the separation zone 48 may be the location where at least some of the gas 30 undergoes disengagement from the liquid of the produced fluid 28 (e.g., the oil 32) due to a pressure decrease that is experienced by the produced fluid 28 as it travels away from the location where the produced fluid 28 is withdrawn from the reservoir 20.

Rather than escaping upward toward the land surface, the separated gas 12 is maintained within the well bore 16 by one or more seals 49 between the casing assembly 22 and the production tube 44 above the second set of perforations 26 forming a pressurized gas region 51 that drives the separated gas toward the gas cap 14. In accordance with present embodiments, a pressure P2 within the pressurized gas region 51 is maintained between the pressure P1 at the downhole reservoir 20 where produced fluid 28 is withdrawn and the gas cap 14 pressure P3. In this way, the produced fluid 28 is driven into the in-situ downhole separation system 10 by P1, and the gas 30 is driven out of solution as P1 reduces to P2. P2, being greater than P3, drives the separated gas 12 into the gas cap 14. It is now recognized that when the distance D is sufficiently large, for instance at least 0.5 km, there are sufficient gravitational forces to keep P1 high enough to allow for this pressure gradient. In accordance with this embodiment, a significant amount of the gas 30 can be removed from the produced fluid 28. By way of non-limiting example, separations in accordance with the embodiment of FIG. 1 may reduce the amount of the gas 30 such that the gas-reduced produced fluid 46 has between 10% and 40%, for example between 20% and 35%, less gas 30 compared to the produced fluid 28 that initially enters the well bore 16. As described below, certain mechanisms may be used to enhance separation.

In addition to using the distance D to facilitate the gas separation and reinjection process as described, the in-situ downhole separation system 10 also encourages the gas-reduced produced fluid 46 to flow toward the inlet 42 of the production tube 44 in a greater amount compared to the produced fluid 28 that initially enters the well bore 16. In the illustrated embodiment, the gas separation tube 40 is configured such that in surrounding the production tube 44, a spill point 50 is formed, the spill point 50 generally corresponding to the end of the first portion 40*a* that is axially opposite the second portion 40*b* (i.e., axially away from the location where the produced fluid 28 enters the well bore 16). More specifically, the spill point 50 represents a location where the gas-reduced produced fluid 46 transitions from the separation zone 48 and spills over into a liquid hold-up 52 as the gas-reduced produced fluid 46 flows toward the production tube 44. The liquid hold-up 52 corresponds to the annular space between the gas separation tube 40 and the production tube 44 along with any open space between the casing assembly 22 and the production tube 44.

As illustrated, the gas-reduced produced fluid 46 flows from the liquid hold-up 52 and into the production tube 44. This flow may be primarily driven by the pressure gradient that exists from P1 to a pressure within the production tube 44 as a result of gravity, but this AP may also be controlled using a pump or similar mechanism to move the gas-reduced produced fluid 46 up the production tube 44 and to the land surface. More particularly, the liquid holdup 52 and flow velocity in the production tube 44 can be carefully selected to maintain the desirable pressure gradient. By way of non-limiting example, the pump or similar mechanism may be located at the land surface (e.g., at a wellhead), or may be used within the well bore 16, such as within the production tube 44. Certain types of separation devices, such as centrifugal separation devices, may also be used to enhance the separation of the gas 30 from the liquid 32. For instance, such a separation device may be located proximate the inlet 42 of the production tube 44, or may be located within the separation zone 48, or a combination thereof. Such devices are described in further detail below.

Thus, methods of separation and production from a subterranean reservoir using the in-situ downhole separation system illustrated in FIG. 1 may include, by way of example, separating gas and liquid within a production well bore formed in a subterranean formation. The methods may generally include positioning a production tube within the production well bore such that the production tube extends from a subterranean reservoir, traverses a gas cap, and out of the production well bore.

In such methods, a gas separation tube is positioned around the production tube such that a spill point is formed, and such that a separation zone is formed between the gas separation tube and a casing of the production well bore. Once these elements are in place, producing fluid from the reservoir causes the fluid to enter the separation zone. The fluid flows within the separation zone in a direction away from the subterranean reservoir and toward the gas cap.

The length of the separation zone, along with the distance between the gas cap and the take off point of the fluid from the reservoir, act to reduce the pressure enough such that at least some gas of the produced fluid separates from liquid of the produced fluid as liberated gas to generate gas-reduced produced fluid, which spills over the spill point and into a liquid holdup between the gas separation tube and the production tube. The produced fluid that flows through the production tube thus has a reduced amount of gas compared to the fluid initially removed from the reservoir.

Figure 2:
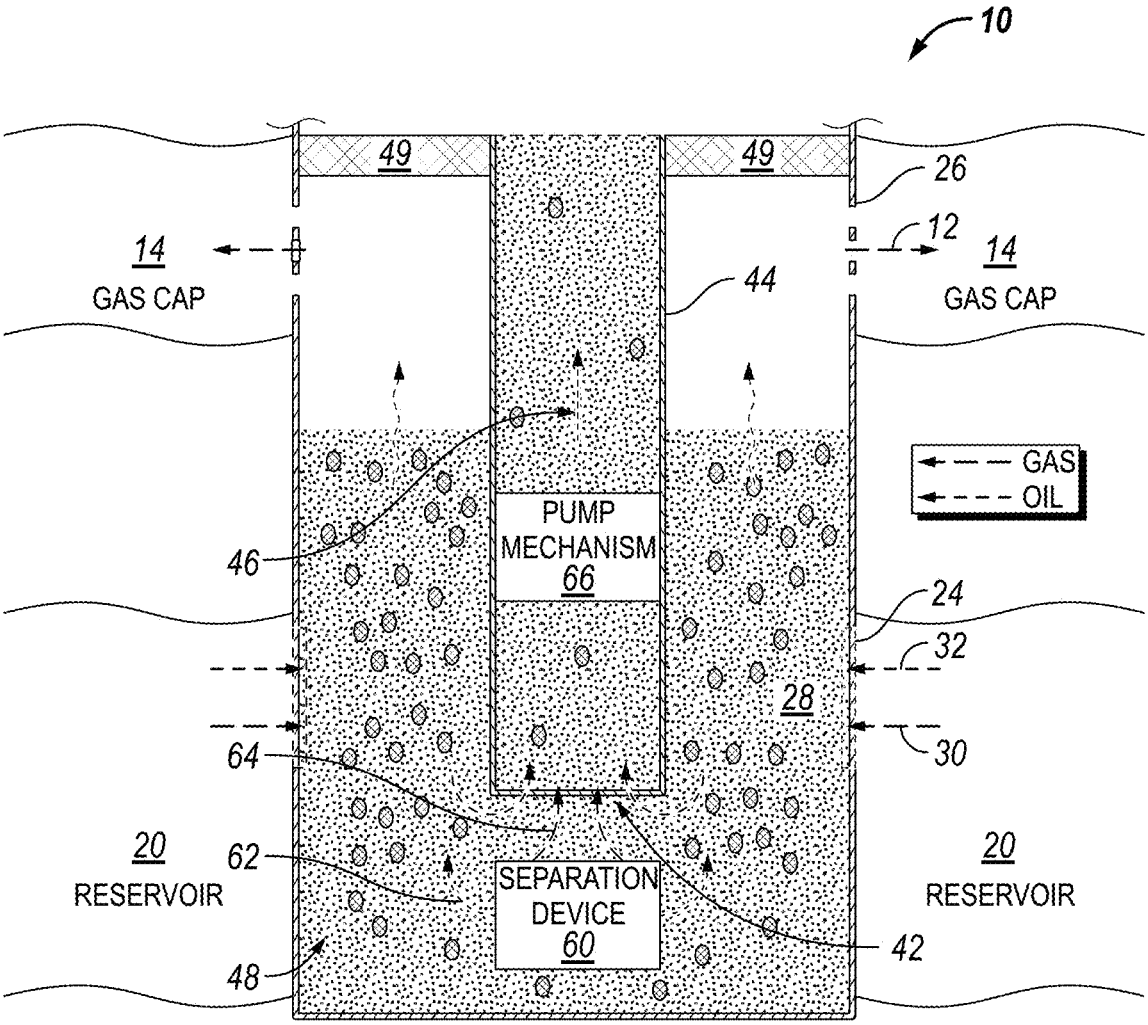
FIG. 2 is a schematic illustration of an in-situ downhole separation system used for separation of oil and gas within a well bore using a pump mechanism and a separation device to drive the separation and reinjection of the separated gas into the formation, in accordance with an embodiment of this disclosure.

As set forth above, certain embodiments of this disclosure may be used with a wide variety of wells, including those that may not have a deep reservoir. In particular, certain embodiments of the in-situ downhole separation system 10 may include features that may use other features (e.g., pumps, separators) in lieu of or in addition to gravitational forces to encourage the gas 30 to separate from the oil 32. One such embodiment is depicted in FIG. 2, which is a schematic diagram of an embodiment of the in-situ downhole separation system 10 that utilizes devices to cause the gas 30 to disengage from the liquid (oil 32) and drive a pressure gradient that motivates the oil 32 through the production tube 44 and toward the land surface (a surface facility). The embodiment of FIG. 2 may or may not use any one or a combination of the features shown in FIG. 1—those features are not shown in FIG. 2 for simplicity.

To encourage separation of at least some of the gas 30 from the oil 32, in the illustrated embodiment of the in-situ downhole separation system 10 includes a separation device 60 located below the inlet 42 of the production tube 44. In other embodiments, the separation device 60 may be located within the separation zone 48. In still further embodiments, more than one separation device 60 may be used (e.g., in the separation zone 48 and/or in proximate the inlet 42 of the production tube 44).

The separation device 60, by way of non-limiting example, may include a device that uses centrifugal forces to cause the gas 30 to disengage from the oil 32, such as a centrifugal separator, a centrifugal pump, or the like. In embodiments where centrifugal forces are used, the separation device 60 may concentrate the disengaged gas in one region of the device 60 (e.g., toward its center), which allows the disengaged gas to be at least partially separated from the remaining liquid as the produced fluid 28 flows through the device 60. In such embodiments, a resulting gas-rich produced fluid 62 and a resulting gas-depleted produced fluid 64 may be channeled away from one another as they move through and exit the separation device 60.

As depicted, the separation device 60 is configured to intake the produced fluid 28, to operate on the produced fluid 28 (e.g., subject it to centrifugal forces) to cause the gas separation and generate the gas-rich produced fluid 62 and the gas-depleted produced fluid 64. In some embodiments, the gas-depleted produced fluid 64 may be the same as the gas-reduced produced fluid 46, may be a majority (e.g., greater than 50% by volume) of the gas-reduced produced fluid 46, or may be a minor portion (e.g., less than 50% by volume) of the gas-reduced produced fluid 46.

As also illustrated in FIG. 2, the separation device 60 ejects the gas-rich produced fluid 62 toward the separation zone 48, which in this embodiment is a region of the well bore 16 located radially outside of the production tube 44 (i.e., between the casing assembly 22 and the production tube 44). Thus, a localized concentration of the separated gas 12 will generally be higher in the separation zone 48, which assists in driving the separated gas 12 completely out of the liquid oil 32 and into the gas cap 14.

While the separation zone 48 is illustrated in FIGS. 1 and 2 as being located in the same well bore 16 as the remaining features of the in-situ downhole separation system 10, other locations are presently contemplated. For instance, in other embodiments, the separation zone 48 may also be associated with a different reservoir (e.g., another oil reservoir or a salted water aquafer reservoir). In such embodiments, the different reservoir may be located a certain minimum distance (e.g., at least 1 km) higher than the reservoir 20.

The illustrated embodiment of FIG. 2 also includes a pump mechanism 66 positioned within the production tube 44. The pump mechanism 66 is generally configured to force the gas-reduced produced fluid 46 through the production tube 44 and up toward the land surface. In other words, the pump mechanism 66 is configured to adjust (e.g., increase) the ΔP such that the level of produced fluid 28 located in the separation zone 48 can be controlled (e.g., increased). Indeed, as an example, the pump mechanism 66 may be used to increase the pressure gradient from the reservoir 20 to the pressurized gas region to increase an amount of the gas 30 that is separated from the oil 32 of the produced fluid 28 within the separation zone 48 (or to further separate gas 30 from oil 32 in the gas-rich produced fluid 62).

The pump mechanism 66 may be any pump or mechanism for moving the gas-reduced produced fluid 46 and controlling the ΔP, including but not limited to a submersible pump, multiphase pump, turbine, and so forth. Further, in other embodiments, the pump mechanism 66 may be a pump located not within the production tube 44 but at the land surface and which is fluidly connected to the production tube 44.

It should be noted that the separation device 60, the pump mechanism 66, or a combination thereof, is not limited to being used in the embodiment of FIG. 2. In some embodiments, for example, the pump mechanism 66, the separation device 60, or both, may be used in combination with the embodiment shown in FIG. 1. Indeed, by way of non-limiting example, separations using the pump mechanism 66 in combination with the embodiment of FIG. 1 may reduce the amount of the gas 30 in the produced fluid 28 such that the gas-reduced produced fluid 46 has between 20% and 80%, for example between 40% and 60%, less gas 30 compared to the produced fluid 28 that initially enters the well bore 16.

ADDITIONAL DESCRIPTION

The following non-limiting clauses are offered as additional description of various example embodiments of the present invention.

Embodiment 1. A method of separating gas and liquid within a well bore formed in a subterranean formation includes positioning a production tube within the production well bore such that the production tube extends from a subterranean reservoir, traverses a gas cap, and out of the production well bore; positioning a gas separation tube around the production tube such that a spill point is formed; producing fluids from the subterranean reservoir such that: the fluid enters a separation zone between the gas separation tube and a casing of the production well bore; the fluid flows within the separation zone in a direction from the subterranean reservoir and toward the gas cap to the spill point; and at least some gas of the produced fluid separates from liquid of the produced fluid as separated gas while the liquid spills over the spill point and into a liquid holdup between the gas separation tube and the production tube.

Embodiment 2. The method of embodiment 1, comprising flowing the separated gas from the separation zone into a pressurized gas region between the production tube and the casing, and from the pressurized gas region into the gas cap.

Embodiment 3. The method of any preceding embodiment, wherein a location where the separated gas is injected into the gas cap is separated from a location where the produced fluid flows from the reservoir into the well bore by a riser section.

Embodiment 4. The method of any preceding embodiment, wherein the riser section is between 0.5 and 1.0 km long.

Embodiment 5. The method of any preceding embodiment, wherein the riser section has a length sufficient to cause gravity to generate enough of a pressure gradient from the reservoir to the gas cap such that a pressure of the pressurized gas region causes the separated gas to be reinjected into the gas cap.

Embodiment 6. The method of any preceding embodiment, wherein flowing the separated gas into the gas cap comprises preventing the separated gas from escaping the well bore using a seal positioned between the production tube and the casing and above the separation zone.

Embodiment 7. The method of any preceding embodiment, wherein flowing the fluid from the subterranean reservoir into the separation zone comprises flowing the fluid through a downhole screen.

Embodiment 8. The method of any preceding embodiment, wherein the downhole screen and the gas separation tube are integral.

Embodiment 9. The method of any preceding embodiment, wherein the gas separation tube prevents the produced fluid from flowing into an inlet of the production tube without first flowing through the separation zone.

Embodiment 10. The method any preceding embodiment, comprising controlling a liquid level within the liquid holdup using a pump located within the production tube.

Embodiment 11. The method of any preceding embodiment, comprising using the pump to increase a pressure gradient from the subterranean reservoir to a pressurized gas region located between the production tube and the casing to increase an amount of the gas that is separated from the liquid of the produced fluid within the separation zone.

Embodiment 12. The method of any preceding embodiment, comprising using a separation device positioned proximate an inlet of the production tube to enhance separation of the gas from the fluid of the produced fluid Embodiment 13. An in-situ downhole separation system comprising: a production well bore formed in a subterranean formation through a gas cap and into a production reservoir, the production well bore having a casing assembly with a first set of perforations configured to allow produced fluid to enter the production well bore from the production reservoir and a second set of perforations configured to allow separated gas to be reinjected into the gas cap; a production tube disposed within the production well bore; a gas separation tube positioned around the production tube and connected to the casing assembly of the production well bore; a separation zone between the gas separation tube and a casing of the production well bore; a liquid holdup between the gas separation tube and the production tube; and a spill point between the separation zone and the liquid holdup; and wherein the in-situ downhole separation system is configured such that the produced fluid enters the separation zone, flows within the separation zone in a direction from the reservoir and toward the gas cap to the spill point, and at least some gas of the produced fluid separates from liquid of the produced fluid as separated gas while the liquid spills over the spill point and into the liquid holdup.

Embodiment 14. The system of embodiment 13, comprising a seal between the production tube and the casing assembly and forming a pressurized gas zone above the separation zone.

Embodiment 15. The system of any preceding embodiment, wherein a distance between the first set of perforations and the second set of perforations is at least 0.5 km.

Embodiment 16. The system of any preceding embodiment, comprising a separation device positioned proximate an inlet of the production tube, wherein the separation device is configured to enhance separation of the gas from the fluid of the produced fluid.

Embodiment 17. The system of any preceding embodiment, comprising a pump mechanism configured to control $\Delta P$ within the production tube, wherein the pump mechanism is capable of increasing a pressure gradient from the production reservoir to a pressurized gas zone located above the separation zone to enhance an amount of gas that is separated from the liquid of the produced fluid within the separation zone.

Embodiment 18. An in-situ downhole separation system comprising: a production well bore formed in a subterranean formation through a gas cap and into a production reservoir, the production well bore having a casing assembly with a first set of perforations configured to allow produced fluid to enter the production well bore from the production reservoir and a second set of perforations configured to allow separated gas to be reinjected into the gas cap; a production tube disposed within the production well bore and sealed against the casing assembly above the second set of perforations to form a pressurized gas zone; a separation device positioned proximate an inlet of the production tube, wherein the separation device is configured to: intake the produced fluid and to separate gas of the produced fluid from oil of the produced fluid as separated gas and thereby generate a gas-rich produced fluid stream and a gas-depleted produced fluid stream; direct the gas-rich produced fluid stream toward a separation zone located under the pressurized gas zone; and direct the gas-depleted produced fluid stream toward an inlet of the production tube; and a pump mechanism configured to control $\Delta P$ within the production tube to control a pressure gradient from the production reservoir to the pressurized gas zone such that the pressurized gas zone has a pressure sufficient to reinject at least some of the separated gas into the gas cap.

Embodiment 19. The system of embodiment 18, wherein the pump mechanism is a submersible pump located within the production tube.

Embodiment 20. The system of any preceding embodiment, wherein the separation device is a centrifugal gas/liquid separator configured to subject the produced fluid to centrifugal forces to separate at least some of the gas of the produced fluid from the oil of the produced fluid.

Embodiment 21. A method of separating gas and liquid within a production well bore using an in-situ downhole separation system, the method comprising: positioning a production tube within the well bore such that the production tube extends from a subterranean reservoir, traverses a gas cap, and out of the production well bore; creating a separation zone between the production tube and a casing of the well bore; creating a pressurized gas region above the separation zone and beneath the land surface; and producing fluids from the subterranean reservoir such that the produced fluid enters the separation zone and flows within the separation zone in a direction from the subterranean reservoir and toward the gas cap such that at least some gas of the produced fluid disengages from the oil of the produced fluid as separated gas that flows into the pressurized gas region.

Embodiment 22. The method of embodiment 21, comprising injecting the separated gas into the gas cap from the pressurized gas region.

Embodiment 23. The method of any preceding embodiment, comprising enhancing separation of the gas from the liquid of the produced fluid using a separation device located proximate an inlet of the production tube or located within the separation zone.

Embodiment 24. The method of any preceding embodiment, comprising enhancing separation of the gas from the liquid of the produced fluid using a pump mechanism located within the production tube.

The specific embodiments of a well bore, reservoir production system, and in-situ downhole separation system described above have been shown by way of example, and it should be understood that these embodiments may be susceptible to various modifications and alternative forms, and can also be used in any appropriate combination. It should be further understood that the claims are not intended to be limited to the particular forms disclosed, but rather to cover all modifications, equivalents, and alternatives falling within the spirit and scope of this disclosure.

The invention claimed is:

1. A method of separating gas and liquid within a well bore formed in a subterranean formation comprising:

positioning a production tube within the production well bore such that the production tube extends from a subterranean reservoir, traverses a gas cap, and out of the production well bore, wherein the gas cap is an injection zone located outside of a casing of the production well bore;

positioning a gas separation tube around the production tube such that a spill point is formed;

producing fluids from the subterranean reservoir such that:

the fluid enters a separation zone between the gas separation tube and the casing of the production well bore;

the fluid flows within the separation zone in a direction from the subterranean reservoir and toward the gas cap to the spill point; and at least some gas of the produced fluid separates from liquid of the produced fluid as separated gas while the liquid spills over the spill point and into a liquid holdup between the gas separation tube and the production tube; and flowing the separated gas from the separation zone into a pressurized gas region between the production tube and the casing, and from the pressurized gas region into the gas cap outside the casing, in response to a pressure gradient and without using a gas compressor.

2. The method of claim 1, wherein a location where the separated gas is injected into the gas cap is separated from a location where the produced fluid flows from the reservoir into the well bore by a distance greater than 0.5 km.

3. The method of claim 1, wherein flowing the separated gas into the gas cap comprises preventing the separated gas from escaping the well bore using a seal positioned between the production tube and the casing and above the separation zone.

4. The method of claim 1, wherein flowing the fluid from the subterranean reservoir into the separation zone comprises flowing the fluid through a downhole screen.

5. The method of claim 4, wherein the downhole screen and the gas separation tube are integral.

6. The method of claim 5, wherein the gas separation tube prevents the produced fluid from flowing into an inlet of the production tube without first flowing through the separation zone.

7. The method claim 1, comprising controlling a liquid level within the liquid holdup using a pump located within the production tube.

8. The method of claim 7, comprising using the pump to increase the pressure gradient from the subterranean reservoir to a pressurized gas region located between the production tube and the casing to increase an amount of the gas that is separated from the liquid of the produced fluid within the separation zone.

9. The method of claim 8, comprising using a separation device positioned proximate an inlet of the production tube to enhance separation of the gas from the fluid of the produced fluid.

10. The method of claim 1, wherein the gas separation tube is connected to the casing at a location vertically below a location where the fluid enters the separation zone.

11. The method of claim 1, wherein the fluid entering the separation zone comprises gas dissolved in liquid.

12. An in-situ downhole separation system comprising:

a production well bore formed in a subterranean formation through a gas cap and into a production reservoir, the production well bore having a casing assembly with a first set of perforations configured to allow produced fluid to enter the production well bore from the production reservoir and a second set of perforations configured to allow separated gas to be reinjected into the gas cap;

a production tube disposed within the production well bore;

a gas separation tube positioned around the production tube and connected to the casing assembly of the production well bore;

a separation zone between the gas separation tube and the casing assembly of the production well bore;

a liquid holdup between the gas separation tube and the production tube; and a spill point between the separation zone and the liquid holdup wherein the in-situ downhole separation system is configured such that the produced fluid enters the separation zone, flows within the separation zone in a direction from the reservoir and toward the gas cap to the spill point, at least some gas of the produced fluid separates from liquid of the produced fluid as separated gas while the liquid spills over the spill point and into the liquid holdup, and the separated gas is reinjected into the gas cap in response to a pressure gradient and without using a gas compressor.

13. The system of claim 12, comprising a seal between the production tube and the casing assembly and forming a pressurized gas zone above the separation zone.

14. The system of claim 13, wherein a distance between the first set of perforations and the second set of perforations is at least 0.5 km.

15. The system of claim 13, wherein the separation zone and the pressurized gas zone are continuous with each other within an annulus of the production well bore surrounding the production tube.

16. The system of claim 12, comprising a separation device positioned proximate an inlet of the production tube, wherein the separation device is configured to enhance separation of the gas from the fluid of the produced fluid.

17. The system of claim 12, comprising a pump mechanism configured to control AP within the production tube, wherein the pump mechanism is capable of increasing the pressure gradient from the production reservoir to a pressurized gas zone located above the separation zone to enhance an amount of gas that is separated from the liquid of the produced fluid within the separation zone.

18. The system of claim 12, wherein the gas separation tube is connected to the casing assembly at a location vertically below the first set of perforations.

19. An in-situ downhole separation system comprising:

a production well bore formed in a subterranean formation through a gas cap and into a production reservoir, the production well bore having a casing assembly with a first set of perforations configured to allow produced fluid to enter the production well bore from the production reservoir and a second set of perforations configured to allow separated gas to be reinjected into the gas cap;

a production tube disposed within the production well bore and sealed against the casing assembly above the second set of perforations to form a pressurized gas zone;

a separation device positioned proximate an inlet of the production tube, wherein the separation device is configured to:

intake the produced fluid and to separate gas of the produced fluid from oil of the produced fluid as separated gas and thereby generate a gas-rich produced fluid stream and a gas-depleted produced fluid stream;

direct the gas-rich produced fluid stream toward a separation zone located under the pressurized gas zone; and direct the gas-depleted produced fluid stream toward an inlet of the production tube; and a pump mechanism configured to control AP within the production tube to control a pressure gradient from the production reservoir to the pressurized gas zone such that the pressurized gas zone has a pressure sufficient to reinject at least some of the separated gas into the gas cap without using a gas compressor.

20. The system of claim 19, wherein the pump mechanism is a submersible pump located within the production tube.

21. The system of claim 19, wherein the separation device is a centrifugal gas/liquid separator configured to subject the produced fluid to centrifugal forces to separate at least some of the gas of the produced fluid from the oil of the produced fluid.

22. A method of separating gas and liquid within a production well bore using an in-situ downhole separation system, the method comprising:

positioning a production tube within the well bore such that the production tube extends from a subterranean reservoir, traverses a gas cap, and out of the production well bore, wherein the gas cap is an injection zone located outside of a casing of the production well bore;

creating a separation zone between the production tube and the casing of the well bore;

creating a pressurized gas region above the separation zone and beneath the land surface;

producing fluids from the subterranean reservoir such that the produced fluid enters the separation zone and flows within the separation zone in a direction from the subterranean reservoir and toward the gas cap such that at least some gas of the produced fluid disengages from the oil of the produced fluid as separated gas that flows into the pressurized gas region; and injecting the separated gas into the gas cap from the pressurized gas region in response to a pressure gradient and without using a gas compressor.

23. The method of claim 22, comprising enhancing separation of the gas from the liquid of the produced fluid using a separation device located proximate an inlet of the production tube or located within the separation zone.

24. The method of claim 22, comprising enhancing separation of the gas from the liquid of the produced fluid using a pump mechanism located within the production tube.

* * * * *